US005540243A

United States Patent [19]

Simonton

[11] Patent Number: 5,540,243

[45] Date of Patent: Jul. 30, 1996

[54] FINGERNAIL PROTECTOR

[75] Inventor: Cheryl A. Simonton, Kenosha, Wis.

[73] Assignee: Hands Unlimited Inc., Kenosha, Wis.

[21] Appl. No.: 488,576

[22] Filed: Jun. 8, 1995

[51] Int. Cl.[6] ..... A45D 29/00

[52] U.S. Cl. ..... 132/73; 132/285; 132/76.2

[58] Field of Search ..... 132/73, 76.2, 285

[56] References Cited

U.S. PATENT DOCUMENTS

| | | | |
|---|---|---|---|
| D. 329,923 | 9/1992 | Thaxton | D28/56 |
| 2,323,854 | 7/1943 | Silverman | 132/73 |
| 2,458,709 | 1/1949 | Kayer | 132/73 |
| 2,487,101 | 11/1949 | Colby et al. | 132/73 |
| 2,524,322 | 10/1950 | Lipnicki et al. | 132/285 |
| 2,580,893 | 1/1952 | Dee | 132/73 |
| 3,967,631 | 7/1976 | Kosal | 132/73 |
| 4,089,066 | 5/1978 | Dethman | 2/21 |
| 4,960,138 | 10/1990 | Kling | 132/73 |
| 4,966,174 | 10/1990 | Stanczak | 132/73 |
| 4,972,857 | 11/1990 | Stewart et al. | 132/73 |
| 5,085,234 | 2/1992 | Silverman | 132/73 |

*Primary Examiner*—Gene Mancene
*Assistant Examiner*—Pedro Philogene
*Attorney, Agent, or Firm*—Nilles & Nilles

[57] ABSTRACT

Systems and methods for protecting fingernails are described. A fingernail protector includes: a resilient arcuate section having a proximal open end and a distal open end, the arcuate section 1) defining a first axis, 2) including a recess formed in the resilient arcuate section that defines a hinge axis that is substantially parallel to the first axis, the recess increasing the flexibility of the resilient arcuate section with regard to the first axis and 3) subtending an angle of at least approximately 180°; a flared arcuate section connected to the resilient arcuate section, the flared arcuate section having a first open end that is connected to the distal open end of the resilient arcuate section and a second open end, the flared arcuate section rising obliquely away from the resilient arcuate section; and an elongated arcuate section connected to the flared arcuate section, the elongated arcuate section defining a second axis and having i) a connected open end connected to the second open end of the flared arcuate section, and ii) a free open end. All of the connected open end of the elongated arcuate section is connected to the second open end of the flared arcuate section. The systems and methods provide advantages in that the fingernail protector that maintains tactile sensitivity, provides convection currents and can be used with varying length nails.

23 Claims, 2 Drawing Sheets

FINGERNAIL PROTECTOR

BACKGROUND OF THE INVENTION

1. Field of the Invention

The present invention relates generally to the field of fingernail protectors. More particularly, the present invention concerns fingernail protectors that have a clip-on design. Specifically, a preferred embodiment of the present invention is directed to fingernail protectors that have an arcuate shape. The present invention thus relates to fingernail protectors of the type that can be termed arcuately shaped clips-ons.

2. Discussion of the Related Art

Heretofore, it was known in the prior art to provide fingernail protectors. A conventional fingernail protector is typically an O-shaped tapered tube. For example, it has been known to insert the tip of one's finger into the open base of a truncated cone.

A previously recognized problem has been that fingers that are inserted into such O-shaped fingernail protectors loose their tactile sensitivity because the finger pads are covered by the fingernail protector. Therefore, what is needed is a fingernail protector that does not degrade tactile sensitivity.

An unsatisfactory previously recognized solution to the problem of tactile sensitivity degradation was to provide an O-shaped fingernail protector that included a fingertip pad opening. A disadvantage of this previously recognized solution is that tactile sensitivity is still degraded by the complete enclosure of at least a portion of the finger by the O-shaped fingertip protector.

Another previously recognized problem has been that heat and moisture builds up within such an O-shaped fingernail protector because the entire perimeter of at least a portion of the finger is enclosed. Therefore, what is also needed is a fingernail protector that does not permit heat and moisture to build up.

One unsatisfactory previously recognized solution to the problem of heat and moisture buildup was to provide fingernail protectors with ventilation holes. A disadvantage of this previously recognized solution is that a large proportion of the surface area of the skin is still covered by such nail protectors. Further, this previously recognized solution also has the disadvantage of not encouraging convection currents across the skin surface of the finger where only one vent hole is provided.

Yet another previously recognized problem has been that fingernail protectors with enclosed tips necessarily limit the length of fingernails that can be inserted into such protectors. Therefore, what is also needed is a fingernail tip protector that does not have a maximum permissible nail length.

An unsatisfactory previously recognized solution to the problem of limited nail length capacity was to provide an open ended truncated conical O-shaped finger nail protector. A disadvantage of this previously recognized solution is that such simple open ended tubes do not permit the dissipation of heat and moisture or the maintenance of tactile sensitivity. Heretofore these requirements have not been fully met without incurring various disadvantages.

The below-referenced U.S. patents disclose embodiments that were at least in-part satisfactory for the purposes for which they were intended but which had certain disadvantages. The disclosures of all the below-referenced prior United States patents in their entireties are hereby expressly incorporated by reference into the present application for purposes including, but not limited to, indicating the background of the present invention and illustrating the state of the art.

U.S. Pat. No. 3,967,631 discloses a fingernail cap. Although this fingernail cap is provided with an opening that permits some degree of tactile sensitivity at the fingertip pad, this fingernail cap completely encloses the tip of the fingernail and completely surrounds the base of the fingertip joint.

U.S. Pat. No. 4,089,066 discloses a fingernail protector. Although this fingernail protector does not limit the length of the nail with which it is used, this fingernail protector completely surrounds the fingertip thereby limiting tactile sensitivity and permitting heat and moisture to accumulate.

U.S. Pat. No. 4,960,138 discloses a fingernail protective device. Although an embodiment of this device permits the accommodation of any length nail, this embodiment necessarily limits tactile sensitivity and is not well suited to dissipating heat and moisture because the majority of the open surface area is located primarily at the tip of the fingernail.

U.S. Pat. No. 4,966,174 discloses a fingernail protector. Although this protector provides for relatively large volume of air around the fingernail, it necessarily limits tactile sensitivity and can only be used with nails of a certain length.

U.S. Pat. No. 4,972,857 discloses a fingernail polish protector. Although this protector provides for relatively large volume of air around the fingernail, it necessarily limits tactile sensitivity.

U.S. Pat. No. 5,085,234 discloses a fingernail shielding method. Although the truncated octagonal shaped tube used by the method permits the accommodation of any length nail, tactile sensitivity is necessarily limited by the method and the dissipation of heat and moisture is necessarily limited by the fact that the sole air vent opening is provided at the tip of the fingernail.

U.S. Pat. No. Des. 329,923 discloses a fingernail protector guard. This fingernail protector guard necessarily limits tactile sensitivity, limits the dissipation of heat and moisture through the provision of only one opening and can only be used with fingernails of a certain length.

SUMMARY OF THE INVENTION

It is therefore an object of the invention to provide a fingernail protector that maintains tactile sensitivity. Another object of the invention is to provide a fingernail protector that provides convection currents. Another object of the invention is to provide a fingernail protector that can be used with varying length nails. Another object of the invention is to provide a fingernail protector that can be clipped-on over the side of a finger so as to be frictionally retained in place, thereby protecting a fingernail. Yet another object of the invention is to provide a fingernail protector that can be manufactured rapidly with a minimum of equipment.

In accordance with a first aspect of the invention, these objects are achieved by providing an arcuate sheath comprising: a resilient arcuate section having a proximal open end and a distal open end, said arcuate section defining a first axis and subtending an angle of at least approximately 180° ; a flared arcuate section connected to said resilient arcuate section, said flared arcuate section having a first open end that is connected to said distal open end of said resilient arcuate section and a second open end, said flared arcuate section rising obliquely away from said resilient arcuate section; and an elongated arcuate section connected to said flared arcuate section, said elongated arcuate section having a connected open end that is connected to said second open end of said flared arcuate section and a free open end, said elongated arcuate section defining a second axis. In a preferred embodiment, the arcuate sheath also includes a first tab connected to said resilient arcuate section, said first tab having a first tab base that is connected to said resilient arcuate section and a first tab top, said first tab extending substantially orthogonally away from said resilient arcuate section and defining a first tab plane that is substantially parallel to said first axis.

Still another object of the invention is to provide a method of protecting a fingernail. In accordance with another aspect of the invention, this object is achieved by providing a method of at least partially enclosing a fingernail in need of protection, said method comprising: providing an arcuate sheath including a resilient arcuate section having a proximal open end and a distal open end, said arcuate section defining a first axis and subtending an angle of at least approximately 180° ; a flared arcuate section connected to said resilient arcuate section, said flared arcuate section having a first open end that is connected to said distal open end of said resilient arcuate section and a second open end, said flared arcuate section rising obliquely away from said resilient arcuate section; and an elongated arcuate section connected to said flared arcuate section, said elongated arcuate section having a connected open end that is connected to said second open end of said flared arcuate section and a free open end, said elongated arcuate section defining a second axis that is substantially parallel to said first axis; and sliding the arcuate sheath over the side of a finger so as to frictionally retain said arcuate sheath on said finger and at least partially enclose said fingernail. In a preferred embodiment, the method also includes applying force to said fingernail protector to deflect said resilient arcuate section.

An effect of the present invention is to protect fingernail polish from becoming physically disrupted while it dries.

Other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification; wherein, like reference numerals designate the same elements in the several views, and in which.

DESCRIPTION OF PREFERRED EMBODIMENTS

The present invention and various features and advantageous details thereof are explained more fully with reference to exemplary, and therefore non-limiting, embodiments described in detail in the following disclosure and with the aid of the drawings.

1. Overview

The fingernail protector according to the present invention is designed to protect fingernails during the polish drying process and enable the polish to dry free of any dents, chips, tears or sheet marks. The fingernail protector is preferably lightweight and smooth.

The presently disclosed fingernail protector works especially well when the base of a polished nail is set at the top of the base of the fingernail protector, and the fingernail protector is clipped to the finger so that air drying vents are close to, but not touching, the top of the fingernail. Accordingly, the fingernail protector is spaced away from the upper surface of a fingernail and does not mar polish that has been coated onto the upper surface of the nail.

The fingernail protector according to the present invention can be used throughout an individual's normal day or may be clipped on at night so as to allow a fingernail to dry as the individual is comfortably sleeping. The fingernail protector fulfills the need for a neat and clean appearance of painted nails and will frequently eliminate the need for repolishing any, or all, of an individual's fingernails. If less than all of an individual's fingernails require repolishing, this situation can be readily addressed by the fact that each finger is individually enclosed by an individual fingernail protector.

The fingernail protector permits day to day living without ruining nails. The fingernail protector is especially useful where children must be attended to. The fingernail protector can include a snap enclosure. The fingernail protector can include air vents. Preferably the base of the fingernail protector has air vents. The fingernail protector can include a bridge on the inner circumference to protect a nail from hitting the top of the fingernail protector. Although the use of polyurethane for subcomponents of the fingernail protector might be advantageous under certain circumstances, such as interchangeable cylindrical springs, polyethylene is preferred because it is not readily soluble in acetone, which is a major component in fingernail polish remover. There is no maximum nail length for use with this embodiment. The fingernail protector will not break, scratch or dent.

2. First Embodiment

Figure 1B:
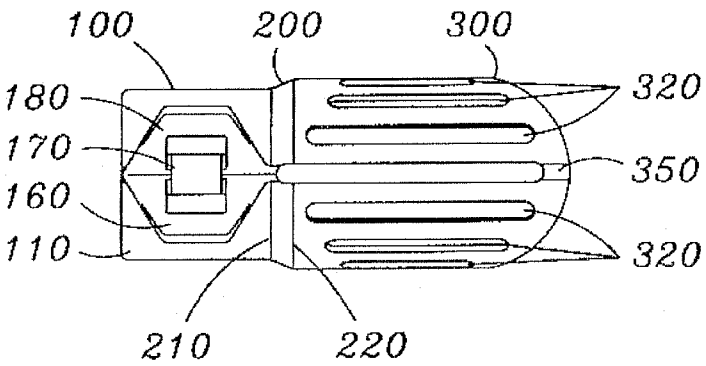
FIG. 1B illustrates a top elevational view of the fingernail protector shown in FIG. 1A.
Figure 1E:
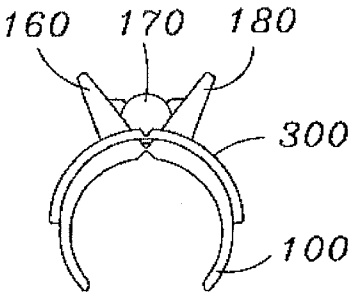
FIG. 1E illustrates a sectional view of the fingernail tip protector shown in FIG. 1A.
Figure 1D:
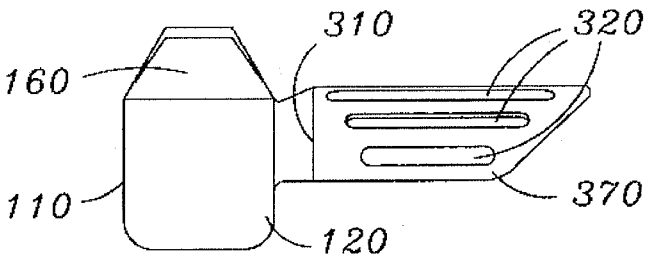
FIG. 1D illustrates a side elevational view of the fingernail tip protector shown in FIG. 1A.
Figure 1A:
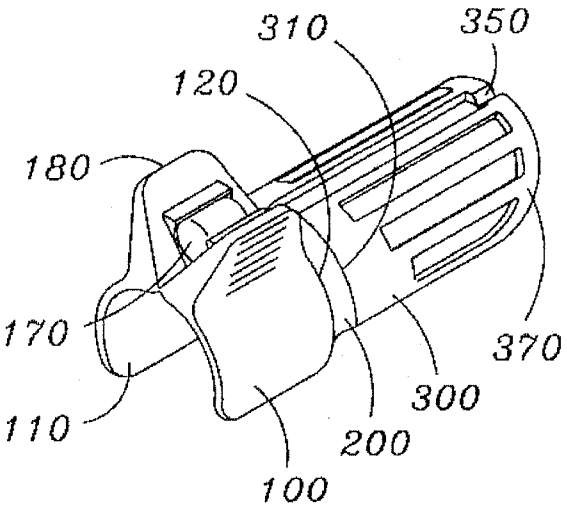
FIG. 1A illustrates an isometric view of a first embodiment of a fingernail protector according to the present invention.

Referring to FIG. 1A, a fingernail protector according to the present invention includes a resilient arcuate section 100.

Resilient arcuate section 100 includes a proximal open end 110 and a distal open end 120. Resilient arcuate section 100 defines a first axis.

The fingernail protector includes a flared arcuate section 200. A first open end 210 of flared arcuate section 200 is connected to the distal open end 120 of resilient arcuate section 100. Flared arcuate section 200 also includes a second open end 220.

The fingernail protector includes an elongated arcuate section 300. A connected open end 310 of elongated arcuate section 300 is connected to the second open end 220 of flared arcuate section 200. Elongated arcuate section 300 defines a second axis. Elongated arcuate section 300 includes a free open end 370, as shown in FIGS. 1A, 1B and 1D.

The bottom of the fingernail protector is open completely so that the pad of a finger to which the fingernail protector is attaches will retain tactile sensitivity. This nearly complete openness also discourages the build up of heat and moisture. While the embodiment shown is fabricated from a single piece of material, subcomponents of the fingernail protector can be fabricated separately, from the same, or other materials.

Referring now to FIG. 1B, the elongated arcuate section 300 can include a plurality of elongated slots 320. Slots 320 are preferably circumferentially distributed around the periphery of elongated arcuate section 300.

Although this embodiment is shown with elongated slots 320 in the C-shaped housing, the elongated slots 320 could be replaced by cylindrical holes. Such air vents, whether slots or holes, permit rapid drying of fingernail products.

The use of a durable and flexible plastic, such as, for example, a polyethylene, or a polypropylene copolymer, permits a "living hinge" to be molded into the fingernail protector. The elongated arcuate section 300 can include a recess 350 that can function as such a "living hinge." Such a "living hinge" permits repetitive and substantial flexure of the fingernail protector along an axis while avoiding permanent polymeric disruption, thereby inhibiting fracture of the material from which the fingernail protector is formed. Recess 350 can define a hinge axis that is preferably substantially coaxial with one of slots 320 and preferably substantially parallel to the second axis.

Figure 1C:
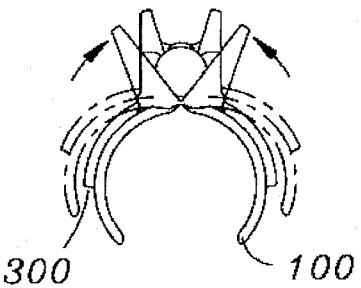
FIG. 1C illustrates a dynamic sectional view of the fingertip protector shown in FIG. 1A.

Referring now to FIG. 1C, the arrows represent forces exerted onto the fingernail protector during a clip-on process, whereby the fingernail protector is removably attached to an individual's finger. The phantom lines indicate the deflected shape of the fingernail protector due to the strain that results from the force represented by the arrows. While elongated arcuate section 300 preferably subtends an angle of less than approximately 180°, resilient arcuate section 100 preferably subtends an angle of more than approximately 180°, so as to provide adequate frictional engagement with the individual's finger. In a preferred embodiment, resilient arcuate section 100 is partially cylindrical. However, resilient arcuate section 100 can approximate a polygonal cross section such as, for example, a square, a hexagon or an octagon.

Referring now to FIG. 1D, the free open end 370 of elongated arcuate section 300 can define an open end plane that is nonorthogonal to both the first axis and the second axis. Preferably, the free open end 370 returns acutely toward resilient arcuate section 100 with regard to said flared arcuate section 200. This geometrical configuration permits the free open end of the fingernail protector to function as an artificial finger tip surface that extends beyond the tip of the finger nail, especially when an individual's finger is slightly bent. Further, for maximum tactile sensitivity, the user can straighten the finger and touch an object with the uncovered pad of the finger. In this instance, the open end of the fingernail protector would rise obliquely away from the object, without necessarily contacting the object.

Referring now to FIG. 1E, a first tab 160 is connected to resilient arcuate section 100 at a first tab base. First tab 160 defines a first tab plane and rises orthogonally away from resilient arcuate section 100. Similarly, a second tab 180 is connected to resilient arcuate section 100 at a second tab base. Second tab 180 defines a second tab plane and rises orthogonally away from resilient arcuate section 100. A compression spring 170 can be located between first tab 160 and second tab 180.

The compression spring 170 is optional and can be omitted from this embodiment. The material from which the compression spring is made has a "memory aspect" that is advantageous to providing a snug fit on the individual's finger. Although this embodiment is depicted as including a squeeze butterfly for expansion of the C-shaped housing, the shape of the butterfly can be modified to any appropriate configuration. Also, the butterfly can be omitted from this embodiment.

It will be appreciated that there is a gap depicted between resilient arcuate section 100 and elongated arcuate section 300. The portion of the fingernail protector that directly surrounds the majority of the fingernail is elongated arcuate section 300 and this structure is slightly angled up. This angling up permits hyperextension of the hand without pushing the outer surface of the nail against the inner surface of the fingernail protector.

Although the preferred embodiment shown in FIGS. 1A–1E includes two tabs, it is within the level of ordinary skill in the art after having knowledge of the invention disclosed herein to provide the fingernail protector with more than two, or less than two tabs.

3. Second Embodiment

Figure 2A:
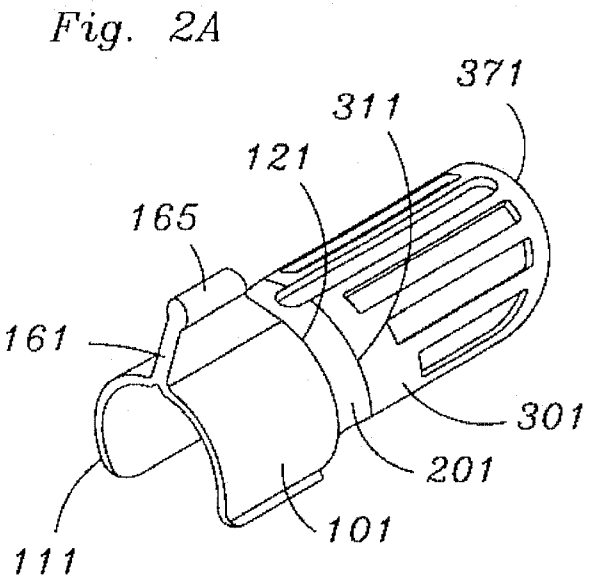
FIG. 2A illustrates an isometric view of a second embodiment of a fingernail protector according to the present invention.

Referring now to FIG. 2A, resilient arcuate section 101 includes a proximal open end 111 and a distal open end 121. Resilient arcuate section 101 defines a first axis.

The fingernail protector includes a flared arcuate section 201. A first open end 211 of flared arcuate section 201 is connected to the distal open end 121 of resilient arcuate section 101. Flared arcuate section 201 also includes a second open end 221.

The fingernail protector includes an elongated arcuate section 301. A connected open end 311 of elongated arcuate section 301 is connected to the second open end 221 of flared arcuate section 201. Elongated arcuate section 301 defines a second axis. Elongated arcuate section 301 includes a free open end 371.

The bottom of this embodiment of the fingernail protector is open completely so that the pad of a finger to which the fingernail protector is attaches will retain tactile sensitivity. Again, this nearly complete openness discourages the build up of heat and moisture. While this embodiment is fabricated from a single piece of material, subcomponents of the fingernail protector can be fabricated separately, from the same, or other materials.

Figure 2B:
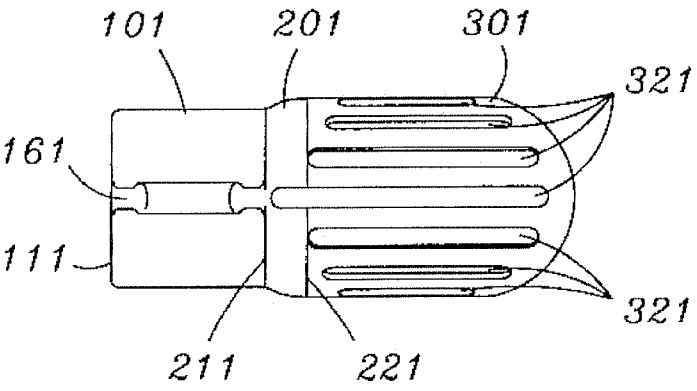
FIG. 2B illustrates a top elevational view of the fingernail protector shown in FIG. 2A.

Referring now to FIG. 2B, the elongated arcuate section 301 can include a plurality of elongated slots 321. Slots 321 are preferably circumferentially distributed around the periphery of elongated arcuate section 301.

Although this embodiment is shown with elongated slots 321 in the C-shaped housing, the elongated slots 321 could be replaced by cylindrical holes. As noted above, such air vents, whether slots or holes, permit rapid drying of fingernail products. While elongated arcuate section 301 preferably subtends an angle of less than 180°, resilient arcuate section 101 preferably subtends an angle of more than 180°, so as to provide adequate frictional engagement with the individual's finger. In a preferred embodiment, resilient arcuate section 101 is partially cylindrical. However, resilient arcuate section 101 can approximate a polygonal cross section such as, for example, a square, a hexagon or an octagon.

Figure 2C:
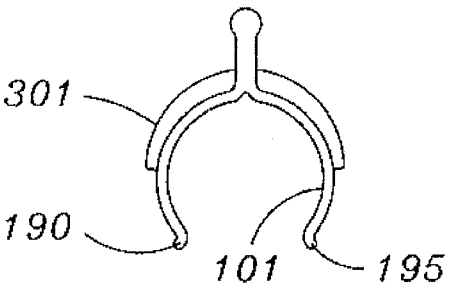
FIG. 2C illustrates a dynamic sectional view of the fingertip protector shown in FIG. 2A.

Referring now to FIG. 2C, resilient arcuate section can include a first radially outwardly turning edge 190 and a second radially outwardly turning edge 195. While elongated arcuate section 301 is preferably less than semicylindrical, resilient arcuate section 101 is preferably more than semicylindrical, so as to provide adequate frictional engagement with the individual's finger.

Figure 2D:
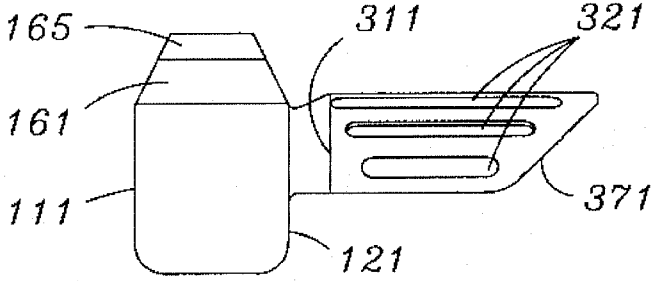
FIG. 2D illustrates a side elevational view of the fingernail tip protector shown in FIG. 2A.

Referring now to FIG. 2D, the free open end 371 of elongated arcuate section 301 can define an open end plane that is not orthogonal to the first axis. Preferably, the free open end 371 returns acutely toward resilient arcuate section 101 with regard to said flared arcuate section 201.

Figure 2E:
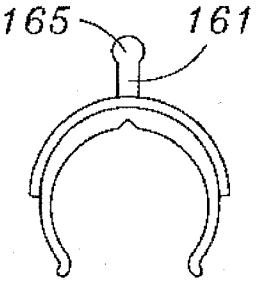
FIG. 2E illustrates a sectional view of the fingernail tip protector shown in FIG. 2A.

Referring now to FIG. 2E, a first tab 161 is connected to resilient arcuate section 101 at a first tab base. First tab 161 defines a first tab plane and rises orthogonally away from resilient arcuate section 101. A substantially cylindrical hem 165 can be provided at the top of first tab 161.

Although this embodiment is depicted as including a single planar tab for griping the C-shaped housing, the shape of the tab can be modified to any appropriate configuration. Further, the tab can be omitted from this embodiment.

It will again be appreciated that there is a gap depicted between resilient arcuate section 101 and elongated arcuate section 301. The portion of the fingernail protector that directly surrounds the majority of the fingernail is elongated arcuate section 301 and this structure is slightly angled up. As noted above, this angling up permits hyperextension of the hand without pushing the outer surface of the nail against the inner surface of the fingernail protector.

Although the preferred embodiment shown in FIGS. 2A–2E includes one tab, it is within the level of ordinary skill in the an after having knowledge of the invention disclosed herein to provide the fingernail protector with more than one tab. Further all tabs can be omitted from the fingernail protector.

The disclosed embodiment shows a tab as the structure for performing the function of providing a separate grip with which to attach and remove the fingernail protector, but the structure for providing a separate grip can be any other structure capable of performing the function of providing a separate grip, including, by way of example a hole, a loop or a handle.

Conveniently, the arcuate sheath of the present invention can be made of any flexible material. For the manufacturing operation, it is moreover an advantage to employ a plastic material, such as for example a polypropylene copolymer (Shell Polypropylene 7C50, high impact copolymer). However, the arcuate sheath of the present invention can be fabricated from any one, or more, of polyethylene, acrylonitrile butadiene styrene (ABS), polyvinyl chloride (PVC), cellulose acetate butyrate (CAB), vinylidene chloride (SARAN), fluorocarbons (TEFLON, KEL-F, KYNAR), polycarbonates, polyurethanes, polypropylenes, nylons, and acetals (DELRIN). The selection of these materials should be based, at least in part, on resistance to acetone which is a common ingredient in fingernail care products.

Conveniently, the fabrication of the present invention can be carried out by using any method such as for example, molding. For the manufacturing operation, it is moreover an advantage to employ a injection molding method.

All the disclosed embodiments are useful in conjunction with providing a protective barrier such as fingernail protectors that are used for the purpose of shielding colored polish that is drying, or for the purpose of shielding clear enamel that is drying, or the like. There are virtually innumerable uses for the present invention, all of which need not be detailed here. All the disclosed embodiments can be realized without undue experimentation.

Although the best mode contemplated by the inventors of carrying out the present invention is disclosed above, practice of the present invention is not limited thereto. It will be manifest to those of ordinary skill in the an that various additions, modifications and rearrangements of the features of the present invention may be made without deviating from the spirit and scope of the underlying inventive concept.

For example, ease of attachment could be enhanced by providing additional or different hinge structures. Similarly, although polypropylene copolymers are preferred as the sheath material, any other suitable material could be used in its place. Similarly, the individual components need not be constructed of the disclosed materials or be formed in the disclosed shapes, but could be provided in virtually any configuration which employs a sheath so as to provide protection for a fingernail in need thereof. Specifically, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended subclaims.

What is claimed is:

1. An arcuate sheath, comprising:

a resilient arcuate section having a proximal open end and a distal open end, said arcuate section 1) defining a first axis, 2) including a recess formed in said resilient arcuate section that defines a hinge axis that is substantially parallel to said first axis, said recess increasing the flexibility of said resilient arcuate section with regard to said first axis and 3) subtending an angle of at least approximately 180°;

a flared arcuate section connected to said resilient arcuate section, said flared arcuate section having a first open end that is connected to said distal open end of said resilient arcuate section and a second open end, said flared arcuate section rising obliquely away from said resilient arcuate section; and an elongated arcuate section connected to said flared arcuate section, said elongated arcuate section having a connected open end that is connected to said second open end of said flared arcuate section and a free open end, said elongated arcuate section defining a second axis;

wherein all of said connected open end of said elongated arcuate section is connected to said second open end of said flared arcuate section.

2. The arcuate sheath of claim 1, wherein said elongated arcuate section includes a plurality of elongated slots that are circumferentially distributed around the periphery of said elongated arcuate section and are substantially parallel to said second axis.

3. The arcuate sheath of claim 2, wherein at least one of said plurality of elongated slots extends into said flared arcuate section, said at least one of said plurality of elongated slots increasing the flexibility of the flared arcuate section with regard to said first axis and said second axis.

4. The arcuate sheath of claim 1, wherein said free open end of said elongated arcuate section defines an external open end plane that is nonorthogonal to both said first axis and said second axis, said free open end returning acutely toward said resilient arcuate section with regard to said flared arcuate section.

5. The arcuate sheath of claim 1, wherein said resilient arcuate section is partially cylindrical and formed from at least one material selected from the group consisting of polyethylene, polypropylene and polyurethane.

6. The arcuate sheath of claim 1, wherein said resilient arcuate section includes a first radially outwardly turning edge and a second radially outwardly turning edge.

7. The arcuate sheath of claim 1, further comprising a first tab connected to said resilient arcuate section, said first tab having a first tab base that is connected to said resilient arcuate section and a first tab top, said first tab extending substantially orthogonally away from said resilient arcuate section and defining a first tab plane that is substantially parallel to said first axis.

8. The arcuate sheath of claim 7, further comprising a substantially cylindrical hem connected to said first tab top, said substantially cylindrical hem defining a third axis that is substantially parallel to said first axis.

9. The arcuate sheath of claim 8, wherein said resilient arcuate section is formed from a polypropylene copolymer.

10. The arcuate sheath of claim 7, further comprising a second tab connected to said resilient arcuate section, said second tab having a second tab base that is connected to said resilient arcuate section and a second tab top, said second tab extending substantially orthogonally away from said resilient arcuate section and defining a second tab plane that is substantially parallel to said first axis.

11. The arcuate sheath of claim 10, further comprising a compression spring connected between said first tab and said second tab.

12. The arcuate sheath of claim 11, wherein said compression spring is formed from a polyurethane and said resilient arcuate section is formed from a polypropylene copolymer.

13. A method of at least partially enclosing a fingernail in need of protection, said method comprising:

providing an arcuate sheath including a resilient arcuate section having a proximal open end and a distal open end, said arcuate section 1) defining a first axis, 2) including a recess formed in said resilient arcuate section that defines a hinge axis that is substantially parallel to said first axis, said recess increasing the flexibility of said resilient arcuate section with regard to said first axis and 3) subtending an angle of at least approximately 180°;

a flared arcuate section connected to said resilient arcuate section, said flared arcuate section having a first open end that is connected to said distal open end of said resilient arcuate section and a second open end, said flared arcuate section rising obliquely away from said resilient arcuate section; and an elongated arcuate section connected to said flared arcuate section, said elongated arcuate section having a connected open end that is connected to said second open end of said flared arcuate section and a free open end, said elongated arcuate section defining a second axis that is substantially parallel to said first axis;

wherein all of said connected open end of said elongated arcuate section is connected to said second open end of said flared arcuate section; and sliding the arcuate sheath over the side of a finger so as to frictionally retain said arcuate sheath on said finger and at least partially enclose said fingernail.

14. The method of claim 13, further comprising applying force to said fingernail protector to deflect said resilient arcuate section.

15. The method of claim 14, wherein providing an arcuate sheath includes providing an arcuate sheath wherein at least one of said plurality of elongated slots extends into said flared arcuate section, said at least one of said plurality of elongated slots increasing the flexibility of the flared arcuate section with regard to said first axis and said second axis.

16. A fingernail protector comprising:

a resilient arcuate section having a proximal open end and a distal open end, said arcuate section 1) defining a first axis, 2) including a recess formed in said arcuate section that defines a hinge axis that is substantially parallel to said first axis, said recess increasing the flexibility of said resilient arcuate section with regard to said first axis and 3) subtending an angle of at least approximately 180°;

a flared arcuate section connected to said resilient arcuate section, said flared arcuate section having a first open end that is connected to said distal open end of said resilient arcuate section and a second open end, said flared arcuate section rising obliquely away from said resilient arcuate section; and an elongated arcuate section connected to said flared arcuate section, said elongated arcuate section defining a second axis and having i) a connected open end connected to said second open end of said flared arcuate section, and ii) a free open end, wherein all of said connected open end of said elongated arcuate section is connected to said second open end of said flared arcuate section.

17. The fingernail protector of claim 16 further comprising a first tab connected to said resilient arcuate section, said first tab having a first tab base that is connected to said resilient arcuate section and a first tab top, said first tab extending substantially orthogonally away from said resilient arcuate section and defining a first tab plane that is substantially parallel to said first axis.

18. The fingernail protector of claim 17, further comprising a substantially cylindrical hem connected to said first tab top, said substantially cylindrical hem defining a third axis that is substantially parallel to said first axis.

19. The fingernail protector of claim 16, wherein said resilient arcuate section is partially cylindrical and formed from a polypropylene copolymer.

20. The fingernail protector of claim 16, wherein said resilient arcuate section includes a first radially outwardly turning edge and a second radially outwardly turning edge.

21. The fingernail protector of claim 16, wherein 1) said elongated arcuate section includes a plurality of elongated slots that are i) circumferentially distributed around a periphery of said elongated arcuate section and ii) substantially parallel to said second axis, and 2) said free open end defines an external open end plane that is not orthogonal to said second axis, said free open end returning acutely toward said resilient arcuate section with regard to said flared arcuate section.

22. The fingernail protector of claim 21, wherein at least one of said plurality of elongated slots extends into said flared arcuate section, said at least one of said plurality of elongated slots increasing the flexibility of the flared arcuate section with regard to said first axis and said second axis.

23. An arcuate sheath, comprising:

a resilient arcuate section having a proximal open end and a distal open end, said arcuate section defining a first axis and subtending an angle of at least approximately 180°;

a flared arcuate section connected to said resilient arcuate section, said flared arcuate section having a first open end that is connected to said distal open end of said resilient arcuate section and a second open end, said flared arcuate section rising obliquely away from said resilient arcuate section; and an elongated arcuate section connected to said flared arcuate section, said elongated arcuate section having a connected open end that is connected to said second open end of said flared arcuate section and a free open end, said elongated arcuate section defining a second axis, wherein said elongated arcuate section includes a plurality of elongated slots that are circumferentially distributed around the periphery of said elongated arcuate section and are substantially parallel to said second axis and said elongated arcuate section includes a recess defining a hinge axis that is i) substantially coaxial with one of said plurality of elongated slots and ii) substantially parallel to said second axis.

* * * * *